US006216402B1

(12) United States Patent
Van de Laar

(10) Patent No.: US 6,216,402 B1
(45) Date of Patent: Apr. 17, 2001

(54) WINDOW INSTALLATION SYSTEM

(76) Inventor: Kevin Van de Laar, 1292 Concession #1 R.R. #6, Niagara on the Lake, Ontario L0S 1JO (CA)

( * ) Notice: Subject to any disclaimer, the term of this patent is extended or adjusted under 35 U.S.C. 154(b) by 0 days.

(21) Appl. No.: 09/377,237

(22) Filed: Aug. 19, 1999

(51) Int. Cl.[7] ..... E06B 1/04
(52) U.S. Cl. ..... 52/217; 52/204.56
(58) Field of Search ..... 52/745.16, 745.15, 52/217, 204.56; 49/505

(56) References Cited

U.S. PATENT DOCUMENTS 5,655,342 * 8/1997 Guillemet et al. ..... 49/505
5,655,343 * 8/1997 Seals ..... 52/745.15
6,000,191 * 12/1999 Kessler ..... 52/745.15

FOREIGN PATENT DOCUMENTS

325128 * 7/1989 (EP) ..... 52/217
2355152 * 1/1978 (FR) ..... 52/217

* cited by examiner

*Primary Examiner*—Blair M. Johnson

(57) ABSTRACT

A window installation system is provided for use with a window opening of a first size and a window assembly having the frame including an outer periphery having a second size less than the first size. The system includes a plurality of mounting units each mounted between the window opening and the frame. Each mounting unit includes a first strip mounted on the window opening. Associated therewith is a second strip mounted on the frame. Next provided is an elevation assembly for selectively distancing the frame from the window opening.

4 Claims, 2 Drawing Sheets

WINDOW INSTALLATION SYSTEM

BACKGROUND OF THE INVENTION

1. Field of the Invention

The present invention relates to wooden shims and more particularly pertains to a new window installation system for obviating the need for wood shims to securely fit a window or door assembly within an opening in a wall.

2. Description of the Prior Art

The use of wooden shims is known in the prior art. More specifically, wooden shims heretofore devised and utilized are known to consist basically of familiar, expected and obvious structural configurations, notwithstanding the myriad of designs encompassed by the crowded prior art which have been developed for the fulfillment of countless objectives and requirements.

Known prior art wooden shims and the like include U.S. Pat. No. 5,655,342; U.S. Pat. No. 4,870,791; U.S. Pat. No. 5,655,343; U.S. Pat. No. 4,912,879; U.S. Pat. No. 1,669,835; and U.S. Patent Des. 372,540.

In these respects, the window installation system according to the present invention substantially departs from the conventional concepts and designs of the prior art, and in so doing provides an apparatus primarily developed for the purpose of obviating the need for wood shims to securely fit a window or door assembly within an opening in a wall.

SUMMARY OF THE INVENTION

In view of the foregoing disadvantages inherent in the known types of wooden shims now present in the prior art, the present invention provides a new window installation system construction wherein the same can be utilized for obviating the need for wood shims to securely fit a window or door assembly within an opening in a wall.

The general purpose of the present invention, which will be described subsequently in greater detail, is to provide a new window installation system apparatus and method which has many of the advantages of the wooden shims mentioned heretofore and many novel features that result in a new window installation system which is not anticipated, rendered obvious, suggested, or even implied by any of the prior art wooden shims, either alone or in any combination thereof.

To attain this, the present invention is adapted for use with a window opening having a rectangular configuration with a first size. Also included is a window assembly having a glass pane with a frame mounted about a periphery thereof. The frame has an outer periphery with a second size less than the first size. Note FIGS. 1 & 2. Also included is a plurality of mounting units each mounted between the window opening and the window assembly. Each mounting unit includes a first strip with a planar rectangular configuration and a pair of bores formed therein on each end of the strip. In use, the first strip is mounted to the frame of the window assembly via a pair of screws passed through the bores. Associated therewith is a second strip with a planar rectangular configuration. A tab is mounted adjacent a first end of the second strip in perpendicular relationship therewith. The tab of the second strip has a bore formed therein about an axis which is parallel with a remaining portion of the strip. In operation, the second strip is mounted to the window opening such that the tab resides on an inner face of the window opening. Next provided as a component of each of the mounting units is an elevation assembly including an upper extent and a lower extent. Each extent is equipped with a first arm having a first end hingably coupled to a first end of one of the strips and a second end hingably coupled to a sleeve. Further, a second arm is provided having a first end hingably coupled to a second end of one of the strips and a second end hingably coupled to a threaded couple. Note FIGS. 3 & 4. Finally, each elevation assembly includes a bolt having an inboard end with a head including a cross-shaped recess formed therein. A threaded outboard portion of the bolt is adapted for threadedly engaging the threaded couple of the elevation assembly. For rotatably receiving the sleeve of the elevation assembly, the bolt is equipped with a smooth inboard portion. In use, the strips may be manually distanced by rotation of the bolt to align the window within the window assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new window installation system apparatus and method which has many of the advantages of the wooden shims mentioned heretofore and many novel features that result in a new window installation system which is not anticipated, rendered obvious, suggested, or even implied by any of the prior art wooden shims, either alone or in any combination thereof.

It is another object of the present invention to provide a new window installation system which may be easily and efficiently manufactured and marketed.

It is a further object of the present invention to provide a new window installation system which is of a durable and reliable construction.

An even further object of the present invention is to provide a new window installation system which is susceptible of a low cost of manufacture with regard to both materials and labor, and which accordingly is then susceptible of low prices of sale to the consuming public, thereby making such window installation system economically available to the buying public.

Still yet another object of the present invention is to provide a new window installation system which provides in the apparatuses and methods of the prior art some of the advantages thereof, while simultaneously overcoming some of the disadvantages normally associated therewith.

Still another object of the present invention is to provide a new window installation system for obviating the need for wood shims to securely fit a window or door assembly within an opening in a wall.

Even still another object of the present invention is to provide a new window installation system that is for use with a window opening of a first size and a window assembly having the frame including an outer periphery having a second size less than the first size. The system includes a plurality of mounting units each mounted between the window opening and the frame. Each mounting unit includes a first strip mounted on the window opening. Associated therewith is a second strip mounted on the frame. Next provided is an elevation assembly for selectively distancing the frame from the window opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
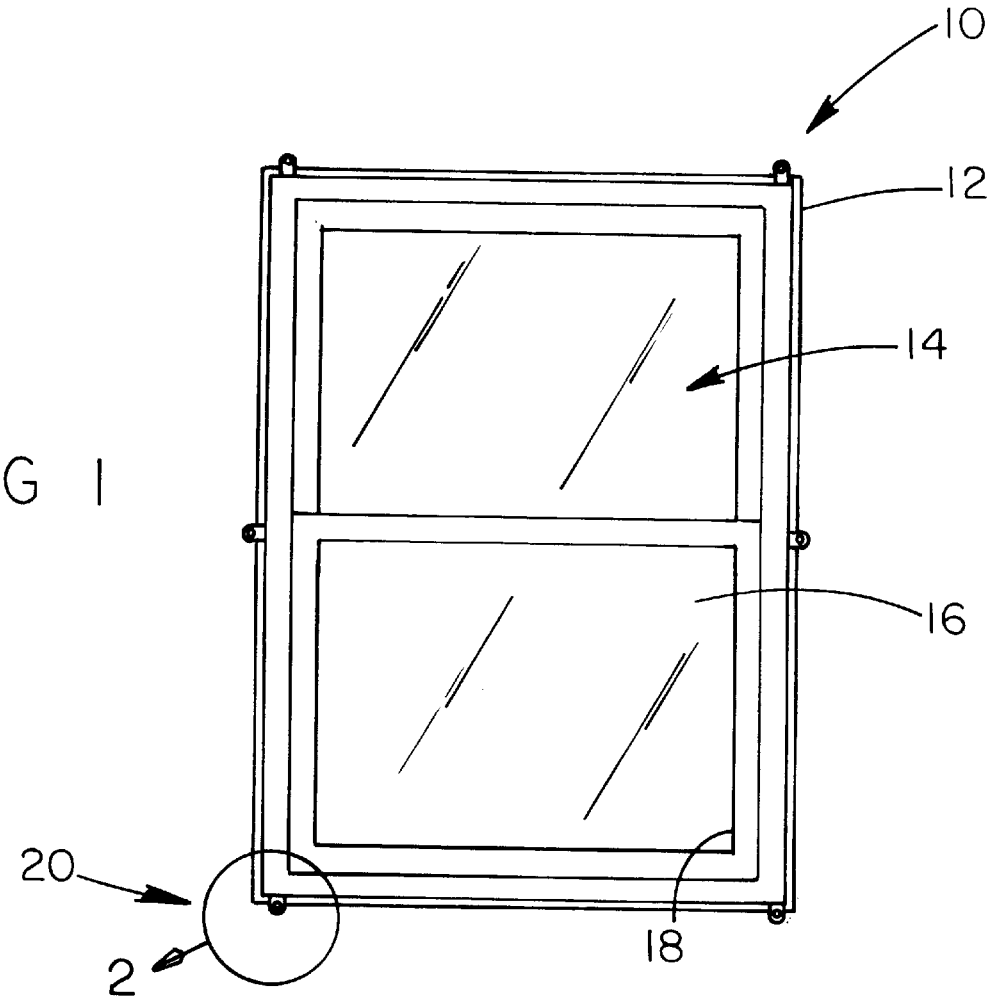
FIG. 1 is a front view of a new window installation system according to the present invention.
Figure 2:
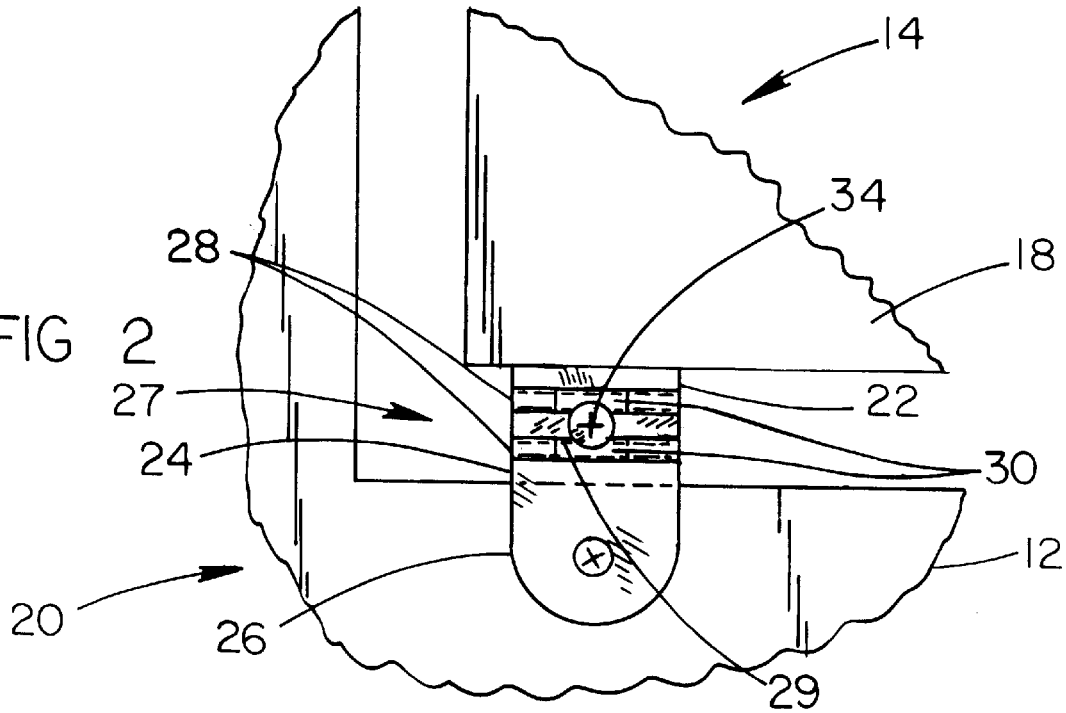
FIG. 2 is a front view of one of the mounting units of the present invention.
Figure 3:
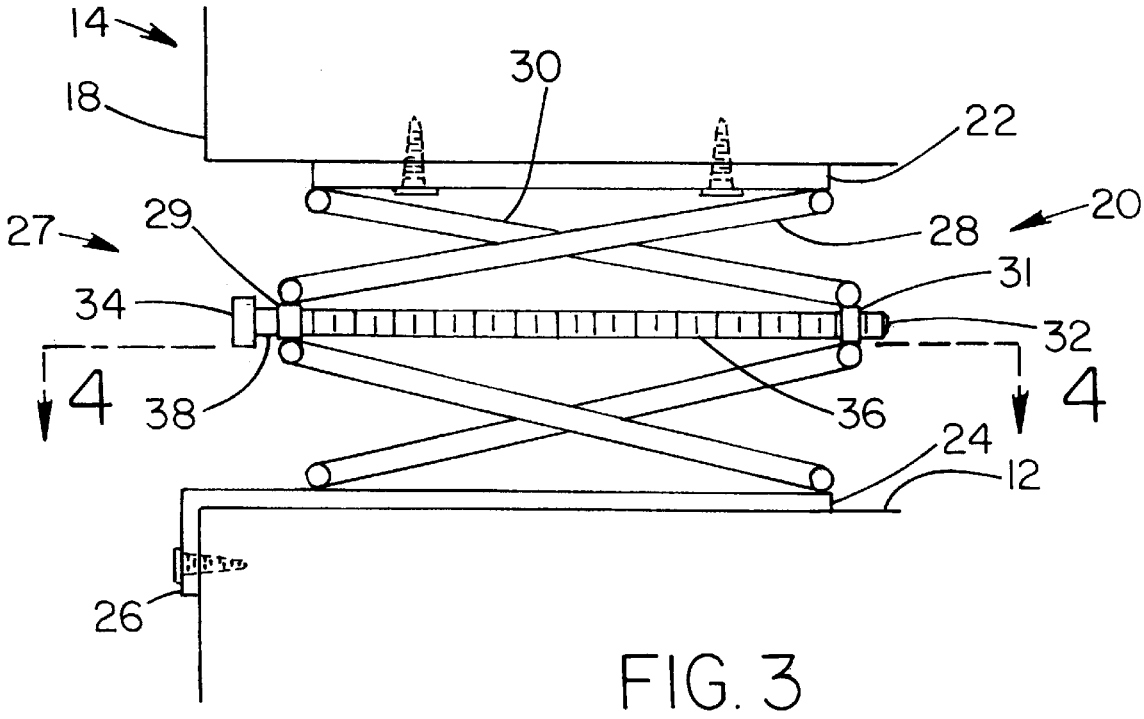
FIG. 3 is a side view of one of the mounting units of the present invention.

With reference now to the drawings, and in particular to FIGS. 1 through 4 thereof, a new window installation system embodying the principles and concepts of the present invention and generally designated by the reference numeral 10 will be described.

The present invention, designated as numeral 10, includes a window opening 12 having a rectangular configuration with a first size. Also included is a window assembly 14 having a glass pane 16 with a frame 18 mounted about a periphery thereof. The frame has an outer periphery with a second size less than the first size. Note FIGS. 1 & 2.

Also included is a plurality of mounting units 20 each mounted between the window opening and the window assembly. Each mounting unit includes a first strip 22 with a planar rectangular configuration and a pair of bores formed therein on each end of the strip. In use, the first strip is mounted to the frame of the window assembly via a pair of screws passed through the bores.

Associated therewith is a second strip 24 with a planar rectangular configuration and a size similar to that of the first strip. A tab 26 is mounted adjacent a first end of the second strip in perpendicular relationship therewith. The tab of the second strip has a bore formed therein about an axis which is parallel with a remaining portion of the strip. In operation, the second strip is mounted to the window opening such that the tab resides on an inner face of the window opening.

Figure 4:
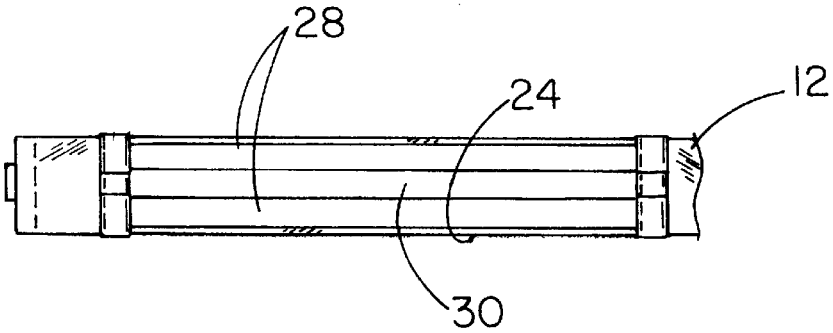
FIG. 4 is a top cross-sectional view of one of the mounting units of the present invention taken along line 4—4 shown in FIG. 3.

Next provided as a component of each of the mounting units is an elevation assembly 27 including an upper extent and a lower extent. Each extent is equipped with a first arm 28 having a first end hingably coupled to a first end of one of the strips and a second end hingably coupled to a sleeve 29. Further, a second arm 30 is provided having a first end hingably coupled to a second end of one of the strips and a second end hingably coupled to a threaded couple 31. Note FIGS. 3 & 4. As best shown in FIG. 4, the first arms each include a pair of parallel members while the second arm includes a central member which passes between the parallel members.

Finally, each elevation assembly includes a bolt 32 having an inboard end with a head 34 including a Philips cross-shaped recess formed therein. A threaded outboard portion 36 of the bolt is adapted for threadedly engaging the threaded couple of the elevation assembly. For rotatably receiving the sleeve of the elevation assembly, the bolt is equipped with a smooth inboard portion 38. As an option, such smooth inboard portion may be flanked with annular flanges. As an option, a pair of oppositely threaded couples may be employed in lieu of the rotatable sleeve. In use, the strips may be manually distanced by rotation of the bolt to align the window within the window assembly. It should be noted that the present invention may also be employed with the installation of doors.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window installation system comprising, in combination:

a window opening having a rectangular configuration with a first size;

a window assembly including a glass pane with a frame mounted about a periphery thereof, the frame having an outer periphery having a second size less than the first size;

a plurality of mounting units each mounted between the window opening and the window assembly, each mounting unit including:

a first strip with a planar rectangular configuration and having a pair of bores formed therein on each end, wherein the first strip is mounted to the frame of the window assembly, a second strip with a planar rectangular configuration and a tab mounted adjacent a first end of the second strip in perpendicular relationship therewith, the tab of the second strip having a bore formed therein, wherein the second strip is mounted to the window opening such that the tab resides on an inner face of the window opening, an elevation assembly including an upper extent and a lower extent each equipped with a first arm having a first end hingably coupled to a first end of one of the strips and a second end hingably coupled to a sleeve and a second arm having a first end hingably coupled to a second end of one of the strips and a second end hingably coupled to a threaded coupler; and a bolt having an inboard end with a head including a cross-shaped recess formed therein, a threaded outboard portion for threadedly engaging the threaded coupler of the elevation assembly and a smooth inboard portion for rotatably receiving the sleeve of the elevation assembly, wherein the strips may be manually distanced by rotation of the bolt to align the window within the window assembly.

2. A building closure installation system comprising:

a building opening with a first size and a building closure including a frame situated about a periphery thereof, the frame including an outer periphery having a second size less than the first size;

a plurality of mounting units each mounted between the building opening and the frame, each mounting unit including:

a first strip adapted for mounting on the opening, a second strip adapted for mounting on the frame;

an elevation assembly adapted for selectively distancing the frame from the opening; and wherein the elevation assembly includes an upper extent and a lower extent each equipped with a first arm having a first end hingably coupled to one of the strips and a second end hingably coupled to a sleeve and a second arm having a first end hingably coupled to a second end of one of the strips and a second end coupled to a threaded coupler;

wherein the strips may be manually distanced by activation of the elongated member thereby changing the distance between the coupler and the sleeve.

3. A window installation system as set forth in claim 2 wherein the elongated member is rotatable about an axis which is perpendicular with respect to a plane in which the frame is situated.

4. A window installation system for a window opening having a substantially rectangular configuration with a first size, the system comprising;

a window assembly including a pane with a frame mounted about a periphery of the pane, the frame having an outer periphery having a second size;

a plurality of mounting units, each mounting unit being adapted for mounting between the window opening and the window assembly, each mounting unit including:

a first strip having a pair of bores formed therein on each end, wherein the first strip is mounted to the frame of the window assembly, a second strip having a tab mounted adjacent a first end of the second strip in a substantially perpendicular relationship therewith, the tab of the second strip having a bore formed therein, wherein the second strip is adapted for mounting to the window opening such that the tab resides on an inner face of the window opening, an elevation assembly including an upper extent and a lower extent each equipped with a first arm having a first end hingably coupled to a first end of one of the strips and a second end hingably coupled to a sleeve and a second arm having a first end hingably coupled to a second end of one of the strips and a second end hingably coupled to a coupler; and a fastener coupling the coupler of the elevation assembly and the sleeve of the elevation assembly, wherein the strips may be manually distanced by rotation of the fastener to align the window within the window assembly.

* * * * *